US007270160B1

(12) United States Patent
Harris, Jr.

(10) Patent No.: US 7,270,160 B1
(45) Date of Patent: Sep. 18, 2007

(54) DEBRIS COLLECTING DEVICE

(76) Inventor: Stanley R. Harris, Jr., 8804 Groton Ct., Lanham, MD (US) 20706

( * ) Notice: Subject to any disclaimer, the term of this patent is extended or adjusted under 35 U.S.C. 154(b) by 0 days.

(21) Appl. No.: 11/497,600

(22) Filed: Aug. 2, 2006

(51) Int. Cl.
*B65B 1/04* (2006.01)

(52) U.S. Cl. ..... 141/391; 141/114; 383/4

(58) Field of Classification Search ..... 141/114, 141/390, 391, 98; 383/4, 16; 242/395; 37/315, 37/316; 294/1.1, 1.3–1.5, 19.2
See application file for complete search history.

(56) References Cited

U.S. PATENT DOCUMENTS 4,112,602 A * 9/1978 Kato et al. ..... 37/316
4,328,930 A * 5/1982 Kalendovsky ..... 242/406
5,167,377 A * 12/1992 Chalmers ..... 225/46
5,709,477 A * 1/1998 Schinasi et al. ..... 383/4
6,090,466 A * 7/2000 Kartisek ..... 428/102

* cited by examiner

*Primary Examiner*—Steven O. Douglas

(57) ABSTRACT

A debris collecting device is disclosed. An illustrative embodiment of the debris collecting device includes a winding frame having a rotatable panel shaft, a collection panel attached to the panel shaft and a collection receptacle carried by the collection panel.

8 Claims, 4 Drawing Sheets

DEBRIS COLLECTING DEVICE

FIELD

The present invention relates to devices for collecting and disposing of debris such as leaves, for example. More particularly, the present invention relates to a debris collecting device which can be spread out to collect debris and rolled up to facilitate loading of the debris into a receptacle for disposal.

BACKGROUND

During the fall months, leaves which fall from trees accumulate on lawns in wooded areas. Homeowners or caretakers expend considerable time and labor raking, gathering and disposing of the leaves, typically at several intervals throughout the season. A typical method of gathering fallen leaves involves raking the leaves into a pile and manually placing the gathered leaves into a trash bag. However, this is laborious and time-consuming.

SUMMARY

The present invention is generally directed to a debris collecting device. An illustrative embodiment of the debris collecting device includes a winding frame having a rotatable panel shaft, a collection panel attached to the panel shaft and a collection receptacle carried by the collection panel.

BRIEF DESCRIPTION OF THE DRAWINGS

The invention will now be described, by way of example, with reference to the accompanying drawings, in which.

DETAILED DESCRIPTION

Figure 1:
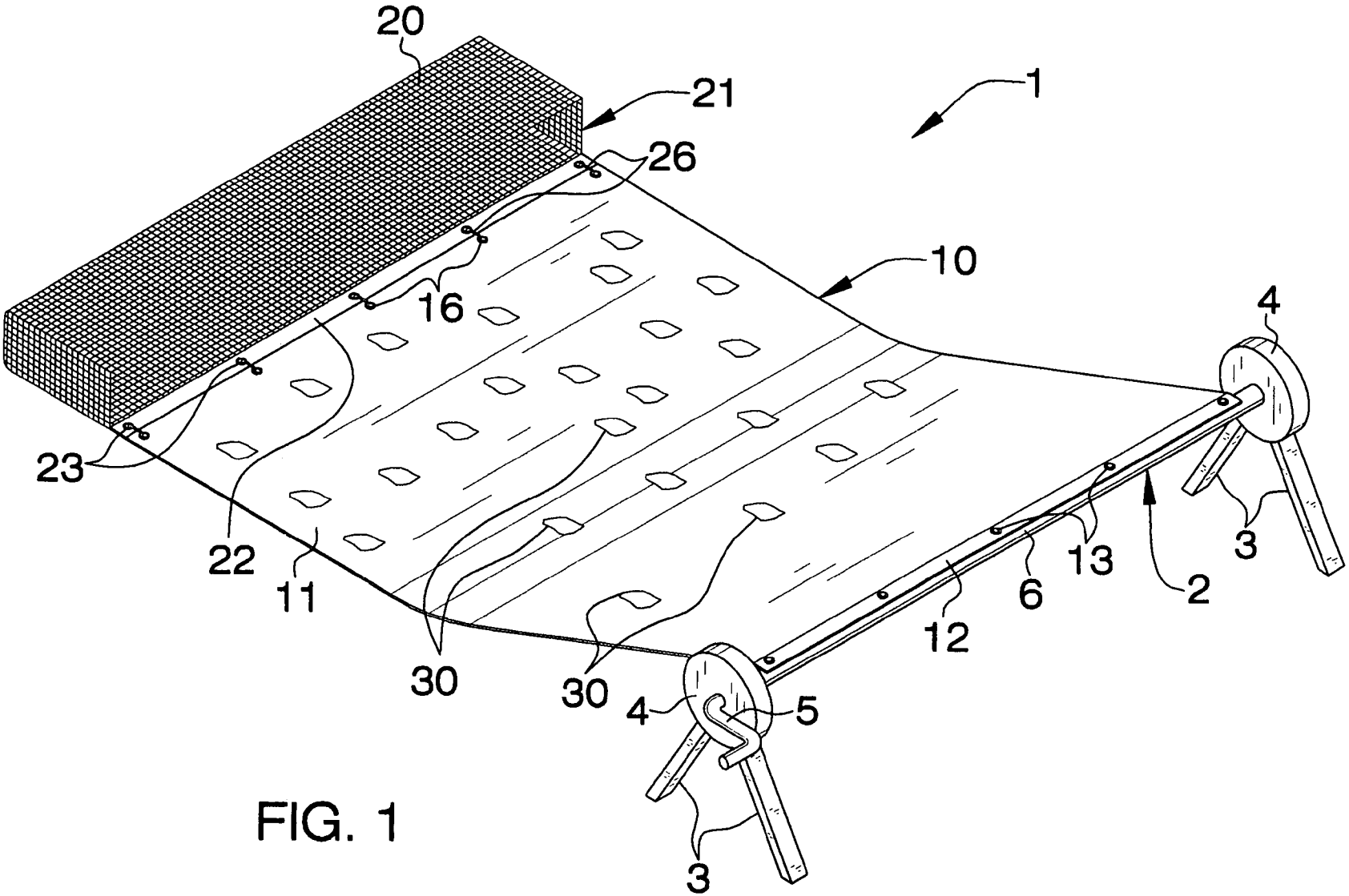
FIG. 1 is a perspective view of an illustrative embodiment of the debris collecting device, shown in an extended, debris-gathering configuration.
Figure 2:
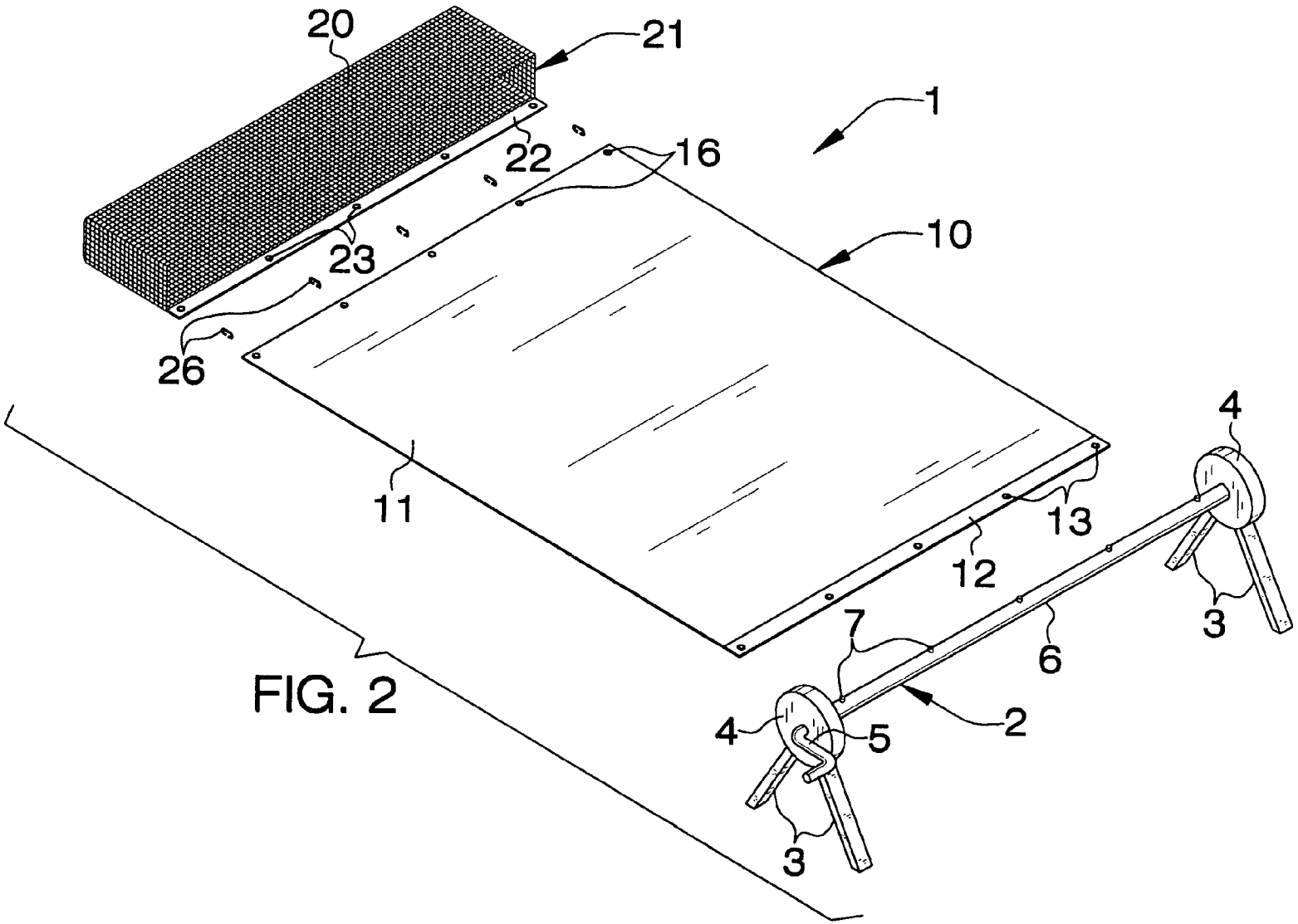
FIG. 2 is an exploded, perspective view of an illustrative embodiment of the debris collecting device.

Referring to the drawings, an illustrative embodiment of the debris collecting device, hereinafter device, is generally indicated by reference numeral 1. The device 1 includes a winding frame 2 typically having two spaced-apart pairs of support legs 3. A shaft housing 4 is provided on each pair of support legs 3. A crank 5 is rotatably mounted in at least one of the shaft housings 4. An elongated panel shaft 6 is rotatably mounted in and extends between the shaft housings 4 and is coupled to the crank 5.

Figure 4:
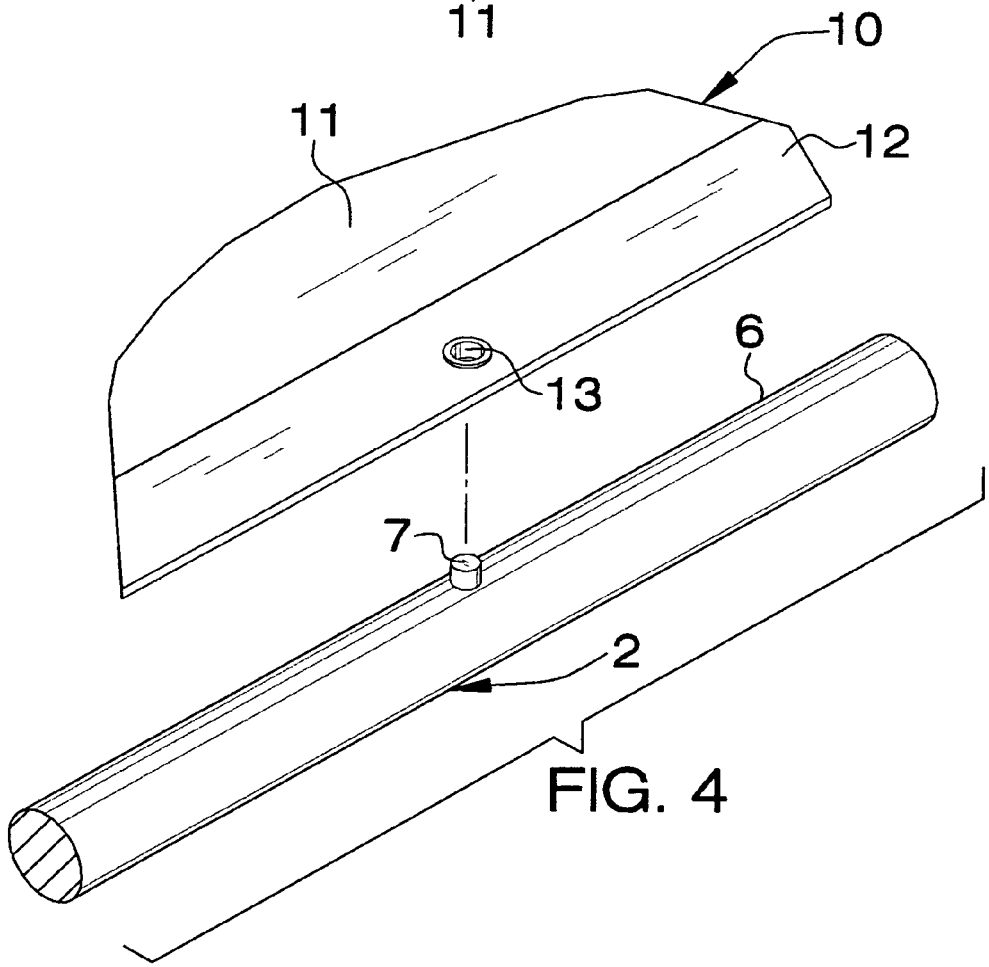
FIG. 4 is an enlarged sectional view which illustrates an illustrative technique for attaching a collection panel element to a winding frame element of an illustrative embodiment of the debris collection device.
Figure 5:
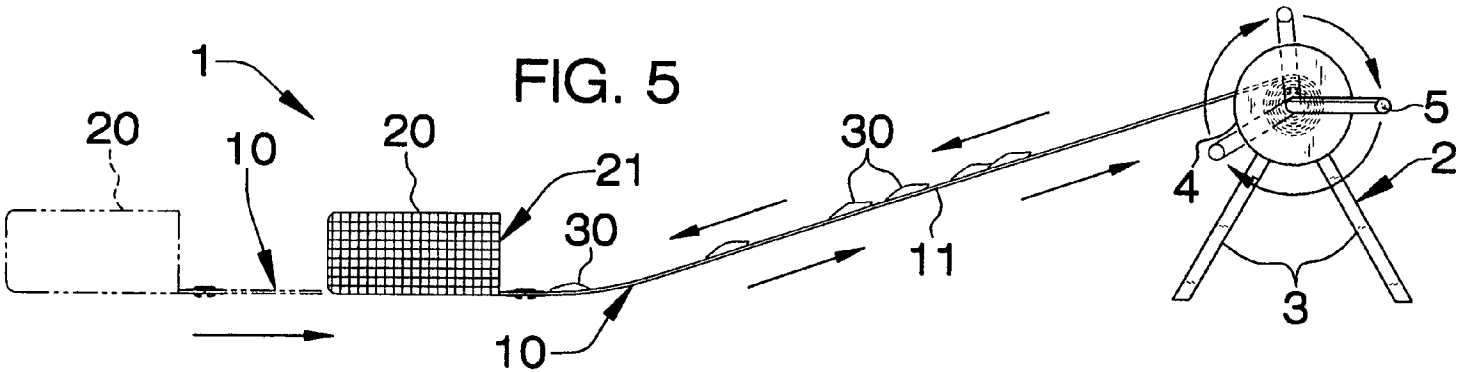
FIG. 5 is a side view of an illustrative embodiment of the debris collection device, more particularly illustrating gathering of debris into a net element of the debris collection device.
Figure 6:
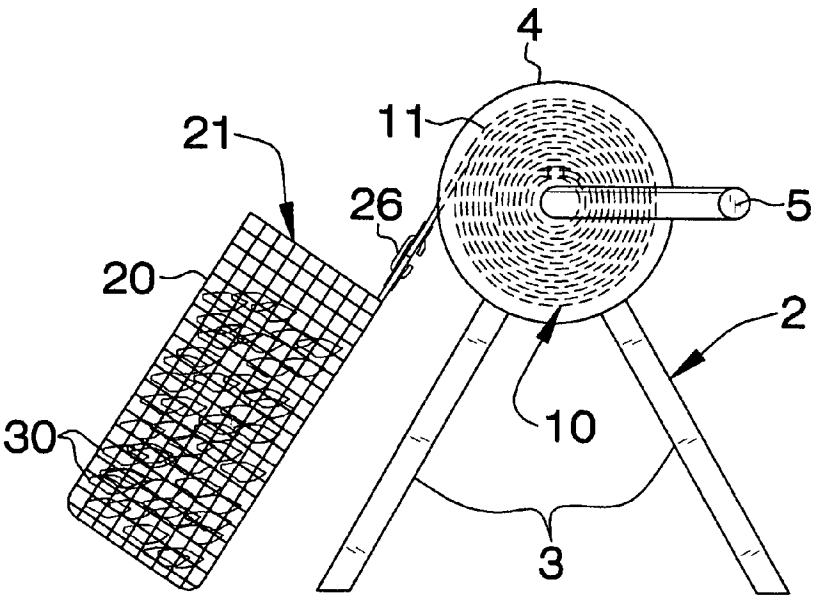
FIG. 6 is a side view of an illustrative embodiment of the debris collection device, with debris fully-collected in the net element of the debris collection device.

A collection panel 10 includes a flexible panel body 11 which may have a generally elongated, rectangular shape. One edge of the panel body 11 is fixedly or detachably attached to the panel shaft 6 of the winding frame 2 using a suitable technique which is known to those skilled in the art. For example, multiple panel attachment tabs 7 may extend from the panel shaft 6 in spaced-apart relationship with respect to each other. Multiple shaft connector openings 13 may extend through the panel body 11. An elongated shaft connector strip 12 may be provided on the panel body 11, in which case the hook openings 16 extend through the shaft connector strip 12 and the panel body 11. As shown in FIG. 4, the panel body 11 of the collection panel 10 is detachably attached to the panel shaft 6 of the winding frame 2 by inserting the panel attachment tabs 7 on the panel shaft 6 through the respective shaft connector openings 13 in the panel body 11. Accordingly, by rotation of the crank 5, the panel body 11 of the collection panel 10 can be selectively wound on the panel shaft 6, as shown in FIGS. 5 and 6 for purposes which will be hereinafter described. It will be understood that alternative techniques known to those skilled in the art may be used to attach the panel body 11 of the collection panel 10 to the panel shaft 6 of the winding frame 2.

Figure 3:
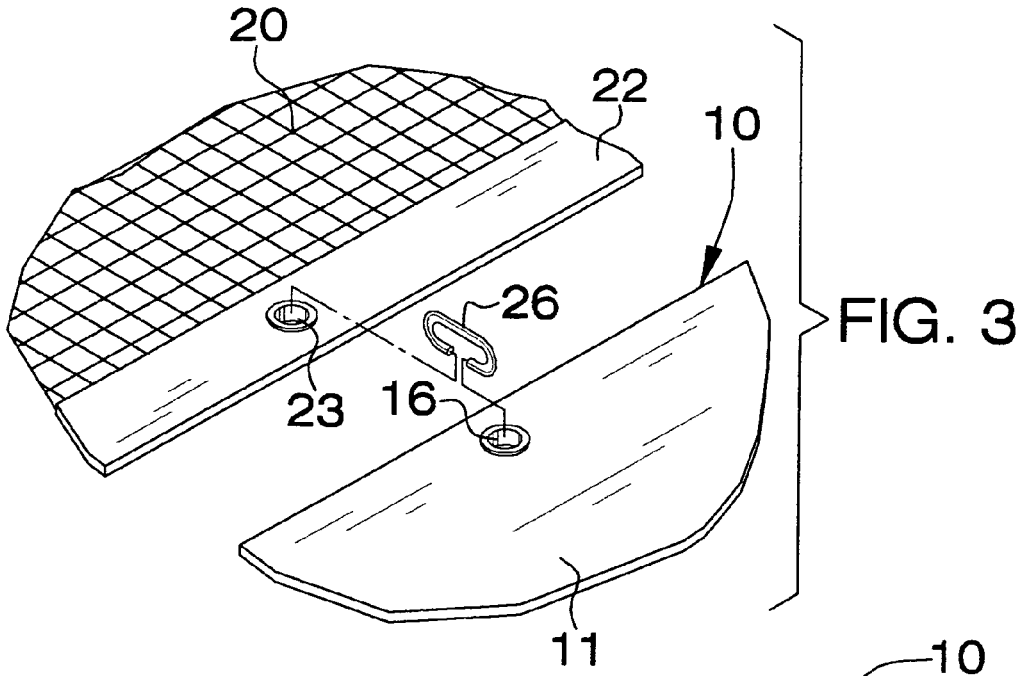
FIG. 3 is an enlarged sectional view which illustrates an illustrative technique for attaching a collection net element to a collection panel element of an illustrative embodiment of the debris collection device.

A collection receptacle 20 is attached to the collection panel 10. The collection receptacle 20 may have a net construction, as shown, and includes a receptacle opening 21 which faces the collection panel 10 and extends across the width of the collection panel 10 when the collection receptacle 20 is attached to the collection panel 10. The collection receptacle 20 may be attached to the panel body 11 of the collection panel 10 using any suitable technique which is known to those skilled in the art. For example, multiple hook openings 16 may be provided in the panel body 11 in spaced-apart relationship with respect to each other. A receptacle connector strip 22 is provided on the collection receptacle 20. Multiple hook openings 23 extend through the receptacle connector strip 22 in spaced-apart relationship with respect to each other and register with the respective hook openings 16 in the panel body 11. As shown in FIG. 3, multiple receptacle attachment hooks 26 can be extended through the hook openings 16 provided in the panel body 11 and the respective registering hook openings 23 provided in the receptacle connector strip 22. It will be understood that alternative techniques known to those skilled in the art may be used to attach the collection receptacle 20 to the collection panel 10.

In typical use of the device 1, the collection panel 10 is attached to the panel shaft 6 of the winding frame 2 and the collection receptacle 20 is attached to the collection panel 10. The collection panel 10 is spread beneath a tree (not shown) and collects leaves 30 which fall from the tree. Additionally or alternatively, the leaves 30 can be raked from the ground (not shown) onto the collection panel 10. The collection panel 10 is then wound on the panel shaft 6 of the winding frame 2 by rotation of the crank 5. Accordingly, as shown in FIG. 5, the collection panel 10 assumes a sloped configuration as it extends from the ground (not shown) to the winding frame 2. This causes the leaves 30 to roll down the collection panel 10 and into the receptacle opening 21 of the collection receptacle 20. After the collection panel 10 is wound on the panel shaft 6 and the collection receptacle 20 reaches the winding frame 2, as shown in FIG. 6, the collection receptacle 20 is typically detached from the collection panel 10 at the receptacle attachment hooks 26 and the leaves 30 emptied into a suitable disposal receptacle (not shown) such as a trash bag, for example. The collection receptacle 20 can subsequently be re-attached to the collection panel 10 and the collection panel 10 unwound from the panel shaft 6 of the winding frame 2 to collect additional leaves 30, typically in similar manner.

While the preferred embodiments of the invention have been described above, it will be recognized and understood that various modifications can be made in the invention and the appended claims are intended to cover all such modifications which may fall within the spirit and scope of the invention.

What is claimed is:

1. A debris collecting device, comprising:

a winding frame having a rotatable panel shaft;

a collection panel attached to said panel shaft;

a collection receptacle carried by said collection panel; and a plurality of panel attachment tabs carried by said panel shaft and a plurality of shaft connector openings provided in said collection panel and receiving said plurality of panel attachment tabs, respectively.

2. The device of claim 1 wherein said winding frame comprises spaced-apart pairs of support legs and wherein said panel shaft is carried by said support legs.

3. The device of claim 2 further comprising a pair of shaft housings carried by said spaced-apart pairs of support legs, respectively, and wherein said panel shaft is carried by said pair of shaft housings.

4. The device of claim 3 further comprising a crank engaging said panel shaft.

5. The device of claim 1 wherein said collection panel comprises a panel body and a shaft connector strip carried by said panel body, and wherein said plurality of shaft connector openings extends through said shaft connector strip.

6. The device of claim 1 wherein said collection panel comprises a panel body and a plurality of hook openings provided in said panel body, and further comprising a plurality of hooks extending through said plurality of hook openings and engaging said collection receptacle.

7. The device of claim 6 further comprising a receptacle connector strip carried by said collection receptacle and a plurality of hook openings provided in said receptacle connector strip, and wherein said plurality of receptacle attachment hooks extends through said plurality of hook openings, respectively.

8. The device of claim 7 wherein said collection receptacle has a net construction.

* * * * *